United States Patent [19]

Lyons

[11] Patent Number: 4,942,991

[45] Date of Patent: Jul. 24, 1990

[54] AMMUNITION CONTAINER

[76] Inventor: Robert M. Lyons, 511 W. 3rd St., Reno, Nev. 89503

[21] Appl. No.: 429,039

[22] Filed: Oct. 30, 1989

[51] Int. Cl.[5] ..... B65D 83/02

[52] U.S. Cl. ..... 224/196; 224/235; 224/245; 224/253; 206/3; 89/34; 221/185

[58] Field of Search ..... 224/196, 245, 253, 918, 224/235, 242; 206/3, 443; 89/34; 221/58, 185, 279

[56] References Cited

U.S. PATENT DOCUMENTS

| | | | |
|---|---|---|---|
| 71,633 | 12/1867 | Newcomb et al. | 224/196 |
| 1,488,016 | 3/1924 | McGregor | 206/3 |
| 2,298,480 | 10/1942 | Harvey | 206/443 X |
| 2,306,365 | 12/1942 | Stair | 224/253 X |
| 2,339,298 | 1/1944 | Shepherd | 206/3 |
| 2,566,569 | 9/1951 | Jensen | 224/245 X |
| 2,753,094 | 7/1956 | Haney, Jr. | 224/245 X |
| 2,868,360 | 1/1959 | Donkin | 206/3 |
| 3,153,500 | 10/1964 | Pachmayr et al. | 224/245 |
| 3,593,873 | 7/1971 | Vonk | 206/3 X |
| 3,604,562 | 9/1971 | Loeffler | 221/279 X |
| 3,619,817 | 11/1971 | Rockwell | 224/245 X |
| 3,756,387 | 9/1973 | Chaney | 206/3 |
| 3,765,298 | 10/1973 | Wallberg | 89/34 |
| 4,484,678 | 11/1984 | Walker et al. | 206/3 |
| 4,733,773 | 3/1988 | La Bianca et al. | 206/3 |
| 4,762,222 | 8/1988 | Martin | 206/3 |

FOREIGN PATENT DOCUMENTS

| | | | |
|---|---|---|---|
| 2033352 | 1/1972 | Fed. Rep. of Germany | 206/3 |
| 1061105 | 4/1954 | France | 206/3 |

*Primary Examiner*—Henry J. Recla
*Assistant Examiner*—Robert M. Fetsuga
*Attorney, Agent, or Firm*—Dowell & Dowell

[57] ABSTRACT

A portable container for storing rounds of ammunition and which includes a housing having a plurality of separately partitioned resilient round supporting pads which function to safely, quietly and cooperatively retain the ammunition within the container and which progressively and partially eject the ammunition as the lid of the container is opened.

16 Claims, 1 Drawing Sheet

AMMUNITION CONTAINER

BACKGROUND OF THE INVENTION

1. Field of the Invention

This invention is generally directed to ammunition containers and more particularly to portable ammunition containers which may be selectively carried by an individual such as on a belt so that separate rounds of ammunition are readily available when necessary for use. The ammunition container of the present invention includes a retractable lid which is slidably received within the container and also includes a plurality of spaced resilient foam round support pads which are contoured so as to receive the bullet ends of rounds of ammunition to thereby cradle and frictionally retain the rounds therein and which prevent the rounds from being adversely impacted against the walls of the container when the container is in use. Each of the foam support pads also functions to lift the rounds of ammunition supported thereby outwardly or upwardly with respect to the container as the lid of the container is moved past an overlying relationship with respect to a given support pad. In this manner, the rounds of ammunition stored within the container may be progressively elevated so that the individual may easily grasp the end of each round of ammunition and remove the round from the container To further stabilize the rounds of ammunition within the container, a plastic lift plate is positioned over each of the support pads. The lift plates engage the shoulder of the rounds of ammunition with the bullet end of each round passing through openings in the lift plate.

The ammunition container of the present invention has been specifically designed so as to promote the safe and secure storage of rounds of ammunition which are carried by an individual and yet provide for the fast and efficient dispensing of rounds of ammunition so that the individual may readily obtain ammunition as is necessary by simply opening the lid to the container and grasping the automatically elevated rounds of ammunition.

In addition to the foregoing, the resilient support pads will accommodate and frictionally engage various sizes of rounds both in length and diameter so that a single ammunition container may be utilized to support a plurality of standard rounds of ammunition without requiring modification or adjustment to the ammunition container.

2. History of the Related Art

There has consistently been a need to provide storage for additional rounds of ammunition that may be utilized by individuals such as hunters and sports persons so that the ammunition will be readily available when necessary. The most traditional ammunition storage containers were in the form of ammunition belts which could be worn around an individual's torso Such belts contained a plurality of spaced round engaging loops through which separate rounds of ammunition could be selectively placed so that the rounds could be withdrawn when necessary. Unfortunately, the use of such belts not only is often awkward but unsafe Belts generally are designed to support a given size of ammunition and therefore different sizes of rounds of ammunition could not be accommodated for in one belt. Also, ammunition belts also have the disadvantage of being unsafe, not only to the person wearing the belt but to other individuals. It is easy for a round of ammunition to become accidentally dislodged from an ammunition belt and be dropped where it could be picked up by someone who should not have access to a live round of ammunition. Also, it is often awkward to remove a round of ammunition from an ammunition belt as the loops associated with such belts may bind against the rounds of ammunition as they are pulled from the belt.

In an effort to promote the safe storage of ammunition, there have been numerous attempts to design and construct ammunition containers which are portable so that the containers may be carried by an individual in the field. Many of the earlier types of ammunition containers were specifically designed to support military use.

Some types of portable ammunition containers provide a plurality of support chambers in which separate rounds of ammunition may be selectively received. Unfortunately, such containers are normally designed to accommodate only a specific size of ammunition and therefore different sizes cannot be accommodated in a single ammunition container. Further, the loose manner in which rounds of ammunition could be placed in such conventional portable ammunition containers would allow rounds of ammunition to move within the support chambers thereby creating potentially unsafe situations and also created distracting and undesirable noise. A further disadvantage of such conventional containers is that in order to remove a round of ammunition from the container, it was frequently necessary to insert one's fingers into the round supporting chambers in an attempt to withdraw a round of ammunition from the container Such manipulation is awkward, often requiring that the ammunition container itself be slightly inverted so as to dislodge or partially dislodge a round of ammunition from one of the support chambers.

In an effort to increase the efficiency in dispensing of rounds of ammunition from ammunition containers of the portable type, some dispensers were designed with ejector mechanisms which could be utilized to selectively eject a round of ammunition from the dispenser as the round is required for use. Unfortunately, many such ejectors require complicated mechanical structures which can become damaged or inoperable after a short period of field use. In addition, some ejectors require extra manipulation to operate the ejector mechanism and therefore not only require an opening of the lid to the ammunition container but then require an operation of the ejector mechanism to obtain a round of ammunition.

An early improvement was made to automatically elevate the rounds of ammunition from a container upon the opening of the container. In U.S. Pat. No. 71,633 to Newcomb & Lyon an ammunition container is disclosed which includes a housing having a plurality of round receiving cells separately defined therein In each of the cells there is provided a spring or other resilient member at the base of the cell which engages the bullet end of a round of ammunition so that the round is resiliently urged towards the opening of the container when the lid of the container is open. Although this structure does provide for the partial elevation of the rounds of ammunition upon the opening of the container, the structure elevates all the ammunition supported therein as the lid is opened and does not provide for a safe and secure retention of the rounds of ammunition when the container lid is either opened or closed. Thus, ammunition can be accidentally displaced after it has been elevated with respect to the opening in the container. Also, due to the structure, any pressure placed on a round of ammunition is placed directly on the tip of the bullet end of the ammunition with the oppositely directed force being placed on the shell end of the round by the lid of the container. In this situation, not only is force being applied to the tip of the bullet but the ammunition is not restrained from shifting within the cells thereby allowing the ammunition to rub against the side walls of each cell. A further disadvantage of the structure is that rounds of different diameter and length are not adequately provided for so that varying sizes of conventional rounds of ammunition cannot be securely supported within a single container.

In view of the foregoing, prior art portable ammunition containers have not provided for both the safe and efficient storage and dispensing of separate rounds of ammunition. Some examples of prior art ammunition and other dispensing containers are disclosed in U.S. Pat. Nos. 368,579, 1,085,075, 1,671,285, 2,226,308, 2,499,652, 3,263,806, and 4,180,192,

SUMMARY OF THE INVENTION

This application is directed to a portable ammunition container of the type which is to be carried by an individual and preferably worn on an individual's belt. The ammunition container includes a housing in which a plurality of vertically extending partitions are spaced with respect to one another. The housing includes an upwardly oriented opening which is selectively closed by a slideable lid which is provided with a plurality of generally parallel living hinges so that the lid may be slidingly received within the housing adjacent one of the end walls thereof. In the preferred embodiment, the leading edge of the lid is shaped so as to cooperate in guiding rounds of ammunition from the interior of the housing.

Mounted between each of the partitions within the housing are separate resilient foam or open cell ammunition supporting pads which terminate in spaced relationship from the lid of the housing. Each of the support pads includes an upper end in which at least one conically shaped cavity has been formed for cooperatively allowing the bullet end of a round of ammunition to be seated therein so as to be securely retained and cushioned with respect to the partitions and side walls of the housing. In the preferred embodiment, a pair of conical openings are provided in spaced relationship in each support pad. To further stabilize rounds of ammunition mounted within the container, a lift plate is inserted in overlying relationship with each support pad. Each lift plate includes openings which cooperatively align with the conical openings formed in each of the support pads. The support plates serve to engage the shoulder of the shell of each round of ammunition placed within the container.

The resilient support pads are of sufficient height within the housing so that a round of ammunition will automatically be raised relative to the opening of the housing upon the retraction of the slideable lid so that each round of ammunition will be raised by the inherent resiliency of the support pads. The pads, however, prevent the accidental displacement of the exposed ammunition until such time as the ammunition is physically lifted from engagement with the pads as the pads frictionally engage each round of ammunition.

It is a primary object of the present invention to provide a portable ammunition container which may be utilized to safely store individual rounds of ammunition and which incorporates resilient support pads which cradle and frictionally retain each of the rounds so as to insure that the bullet portion of each of the rounds cannot be accidently engaged or jarred against the side walls of the housing or the partitions formed inwardly of the housing when the rounds of ammunition are stored within the container.

It is a further object of the present invention to provide a portable ammunition container which includes a plurality of resilient foam support pads which have tapered openings formed in the upper ends thereof for cooperatively allowing the seating of the bullet end of rounds of ammunition therein and which pads are of sufficient resiliency to automatically lift a round of ammunition upwardly with respect to the opening in the container when the lid thereof has been opened. The pads provide a frictional grip upon the bullet end of the ammunition to insure that the rounds cannot be accidentally displaced from the housing even when the lid has been opened.

It is also an object of the present invention to provide an ammunition container which may be carried by an individual and in which a plurality of rounds of ammunition of different sizes may be retained.

It is yet a further object of the present invention to provide a portable ammunition container wherein lift plates are mounted between the partitions within the container which plates are engageable with the shoulder of each round of ammunition to thereby assure proper alignment of the rounds of ammunition within the container and which also limit the vertical displacement of the resilient support pads which support the rounds of ammunition within the container.

It is a further object of the present invention to provide a portable ammunition container which safely encloses individual rounds of ammunition and which includes no metal parts and which may be selectively closed to prevent moisture from entering the container.

It is another object of the present invention to provide a portable ammunition container wherein the ammunition is automatically elevated with respect to the opening into the container upon the opening of a slideable lid so that rounds of ammunition are progressively allowed to be withdrawn from the housing while the remaining rounds are securely enclosed within the housing.

It is a further object of the present invention to provide a portable ammunition container wherein a slideable lid controls the dispensing of the ammunition and which lid is also received within the container as it is moved to an open position

DESCRIPTION OF THE PREFERRED EMBODIMENT

Figure 1:
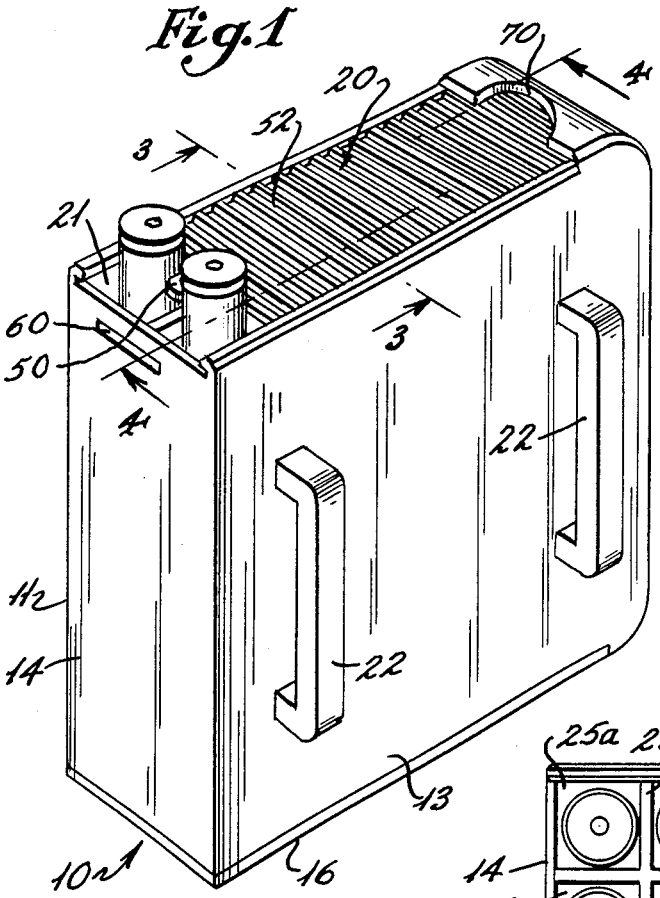
FIG. 1 is a perspective view of the ammunition container of the present invention showing the lid being withdrawn so as to allow two rounds of ammunition which are carried by a common resilient support pad to be lifted relative to the opening in the container for selective removal.

With continued reference to the drawings, the ammunition container 10 of the present invention is shown in FIG. 1 as including a housing 11 having a front wall 12, inner wall 13, end walls 14 and 15 and a lower wall 16. End wall 15 includes an upper accurate portion 17 which extends partially over the upper edges of each of the side walls 12 and 13. A pair of oppositely oriented grooves 18 and 19 are provided adjacent the upper edges of each of the side walls 12 and 13 and define a pair of spaced channels in which a lid 20 is slideably engaged. The lid selectively covers an opening 21 into the container.

In order to allow the housing 11 to be mounted to an individual's belt, at least one belt retention loop 22 is provided along the outer surface of the inner wall 13. In the drawings, two belt retention members 22 are depicted in spaced relationship with respect to one another. In order to make the housing more quickly attachable to an individual's belt, different types of belt mounting clips may be utilized. One such type of clip is disclosed in the applicant's prior U.S. Pat. No. 4,754,528 and entitled Belt Lock Device for Hand Held Object. As opposed to attaching the container to an individual's belt, various clips or clamps may be utilized to support the container to articles of clothing, truck door pockets, automotive visors and the like.

The interior of the ammunition container housing is divided into a plurality of side by side oriented chambers 25*a*–25*e* and 26*a*–26*e* which are separated by a plurality of intersecting partitions 27 and 28. It should be noted that the partitions 27 extend between the side walls 21 and 22 and are generally perpendicular thereto while the partition 28 extends in parallel relationship with respect to the sidewalls and is generally parallel thereto. With specific reference to FIG. 4 of the drawings, the partitions 27 extend from the bottom wall 16 of the housing upwardly to their upper ends 29 which are spaced below and in spaced relationship with respect to the grooves 18 and 19 formed adjacent the upper edges of the side walls 12 and 13.

Figure 3:
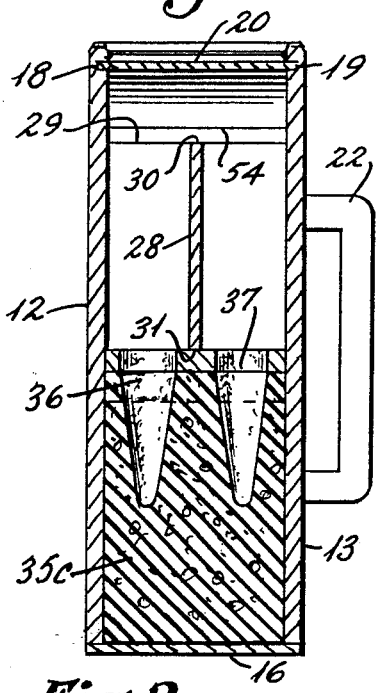
FIG. 3 is a cross sectional view taken along lines 3—3 of FIG. 1.
Figure 2:
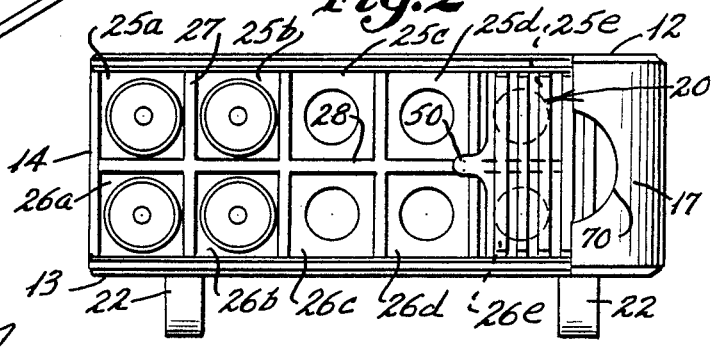
FIG. 2 is a top plan view of the container of FIG. 1 showing the lid being withdrawn to expose four of the five ammunition support pads provided within the housing.

With particular reference to FIG. 3 of the drawings, the partition 28 only extends a portion of the vertical distance of the partitions 27. The upper ends of the partition 28, which is designated at 30, terminates approximately in line with the upper ends 29 of the partitions 27 while the lower end 31 of partition 28 terminates in spaced relationship with respect to the lower wall 16 of the housing and is shown preferably to extend only approximately ½ the depth of the housing for purposes which will be described in greater detail hereinafter. Partition 28 is seated within aligned slots formed in the upper portions of the partitions 27.

Figure 4:
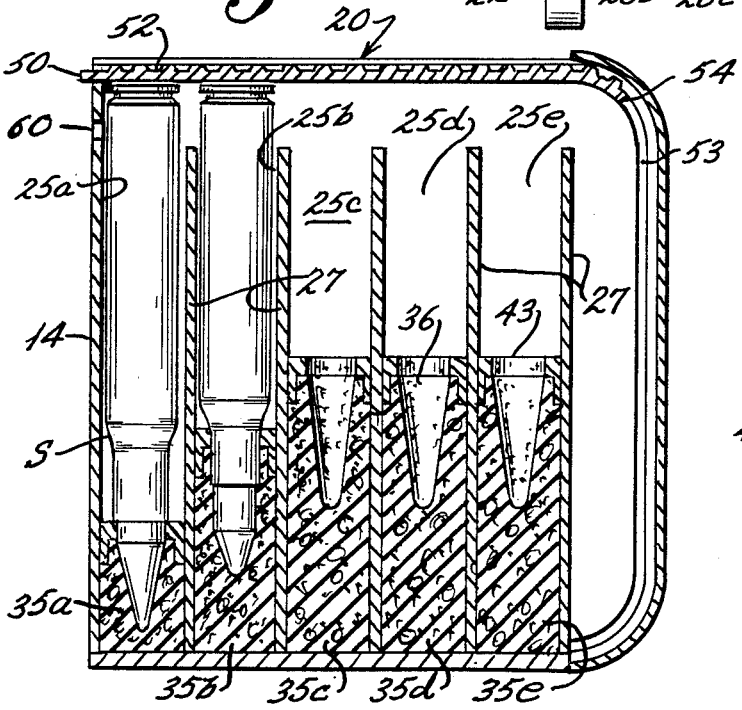
FIG. 4 is a cross sectional view taken along lines 4—4 of FIG. 1.

Due to the spacing between the lower edge 31 of the partitions 28 and the bottom wall 16 of the housing, each pair of side-by-side chambers 25*a*–*e* and 26*a*–*e*, respectively, are in open communication with each other below the partition 28. Mounted in each of the open areas below the partition 28 are resilient open cell or foam ammunition support pads 35*a*–35*e*. Each support pad is separated by one of the partitions 27 so that the support pads may be slidingly guided between the partitions 27 or the partitions 27 and one of the end walls of the housing as the open cell material is collapsed or expanded. As shown in the drawings, the open cell foam material pads are placed within the container so as to fill the areas between the partitions 27 and the lower edge of the partition 28 in an expanded condition. The pads, however, are sufficiently resilient so as to be collapsed as shown in FIG. 4 so that varying lengths or sizes of rounds of ammunition may be placed in contact with the material.

Each of the foam support pads 35*a*–35*e* further includes a pair of generally conically formed cavities or recesses 36 and 37 which are spaced with respect to one another. Each of the recesses 36 and 37 is generally aligned with the central axis of each of the chambers 25*a*–*e* and 26*a*–*e*, respectively. The recesses 36 and 37 are formed so as to cooperatively receive the bullet end of a round of ammunition as is shown or illustrated in FIG. 4 of the drawings. In this manner, the bullet end of the round of ammunition and the area between the bullet and the upper end of the shell is safely cradled within the resilient material thereby protecting the bullet and preventing the engagement of the bullet with any of the partitions, side walls or end walls of the container. The foam pads 35*a*–*e* not only cradle the bullet end of each round of ammunition but also frictionally retain each round of ammunition so that as each round is elevated from the housing by the inherent resiliency of the pads, as is illustrated in FIG. 1, the rounds will not be dislodged but must be urged from the pads by the intentional grasping of each shell and lifting it from the container. Therefore, rounds of ammunition cannot be accidentally dropped from the container until purposely lifted by the individual utilizing the container.

Figure 5:
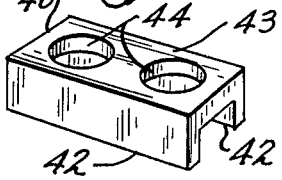
FIG. 5 is a perspective view of one of the round lift plates of the present invention.
Figure 6:
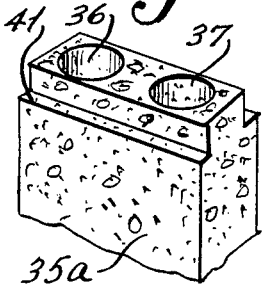
FIG. 6 is a perspective view of the upper end of one of the resilient support pads of the present invention.

To further stabilize each round of ammunition within the housing and to provide a positive slide limit for the vertical lift created by the foam pads 35*a*–*e*, each foam pad is provided along its upper edge with a lift plate 40 which is shown in FIG. 5. To securely retain each lift plate 40 on the upper end of each of the resilient pads 35*a*–*e*, the upper edges of the resilient pads are provided with recesses 41 on which are seated the depending flanges 42 of the lift plates 40. The upper surface 43 of each lift plate is provided with a pair of openings 44 which cooperatively align and are of substantially the same diameter as the openings 36 and 37 formed in the upper end of each pad. With particular reference to FIG. 3 of the drawings, when the lift plates 40 are seated on each of the lift pads 35*a*–*e* and as the pads expand vertically, the upper surface of the lift plate will engage the lower edge 31 of the partition 28 thereby preventing further vertical movement of the lift pads and insuring that the lift plate and pads are retained securely within the lower portion of the housing. In this manner, the vertical lift provided by the resilient pads 35*a*–35*e* is effectively controlled. Therefore, the resilient pads may be slightly compressed when placed within the lower portion of the housing so that rounds of ammunition of very short length will be given a positive lift when the lift pads are compressed even a short distance with respect to the partition 28.

Although the embodiment shown in the drawings reflects that each lift pad includes a pair of recesses 36 and 37 so that two adjacent rounds of ammunition may be lifted simultaneously, it should be noted that the present invention could incorporate a single set of chambers such as 25*a*–*e* or multiple parallel sets including three, four or more recesses for each of the ammunition support pads 35*a–e* thereby increasing the overall capacity of the ammunition container.

The lid 20 of the container controls the selection or partial ejection of each of the rounds of ammunition placed within the ammunition container. With the lid in a closed position as shown in FIG. 4, the base of each shell is rested against the lower surface of the lid and thus the rounds of ammunition prevented from being withdrawn from the interior of the housing. If the lid is moved towards the rear wall 15 of the housing, rounds of ammunition are allowed to be exposed to the opening 21 in the housing and are automatically lifted by the inherent resiliency of the lift pads 35*a–e* so as to be raised slightly above the lid 20 as shown in FIG. 1 so that the shells may be grasped by the individual utilizing the ammunition container. With the embodiment shown in FIG. 1, two rounds of ammunition are simultaneously lifted by each of the support pads 35*a–e* as the lid is moved rearwardly exposing one of the chambers 25*a–e* and a corresponding one of chambers 26*a–e*. To provide further guidance of the shells and to maintain adjacent rounds of ammunition spaced from one another as they are dispensed, the front portion 50 of the lid tapers inwardly to form a pair of recesses 51. Each round of ammunition passes through one of the recesses as they are elevated with respect to the opening 21 in the housing.

The lid 20 of the present invention is further designed to be slideably received within the housing 11 so that the lid does not project from the housing when being opened. To this end, the lid 20 is formed of a plastic material having a plurality of parallel living hinges 52 therein so that the material may be deflected as the lid is opened towards the rear wall 15. To guide the lid as it is being retracted within the housing, the channels formed by the grooves 18 and 19 communicate with vertically extending grooves 53 which define a pair of opposing channels which extend vertically in the side walls 12 and 13 adjacent the rear wall 15 as shown in FIG. 4. The curvature of the lid is shown or illustrated in FIG. 4 with the rear end thereof 54 extending around the curved channels which communicate the grooves 18 and 19 with the grooves 53.

The front end 50 of the lid may be selectively locked in stored position by passing the end through a small opening 60 formed in the front wall 14 of the housing. The front end would include a small notch therein which would seat with the front wall 14 when the lid is closed. To facilitate the closing of the lid after it has been completely opened, an open notch 70 is provided in the curved portion 17 of the end wall 15. The notch exposes a portion of the lid 20 that can be engaged to thereby urge or slide the lid to a closed position.

In the use of the ammunition container of the present invention, with the lid in a fully opened position individual rounds of ammunition may be placed into each of the chambers 25*a–e* and 26*a–e* with the bullet ends B of each of the rounds of ammunition being cooperatively seated within the recesses 36 and 37 of the support pads 35*a–e*. As the rounds are placed into the container, the shoulder S of each of the rounds of ammunition will engage the side of the openings 44 of the lift plates 40 thereby further stabilizing the rounds of ammunition within each of the chambers 25*a–e* and 26*a–e*. Once the rounds have been placed within the chamber, the lid is moved forwardly while simultaneously pushing the end of each of the rounds of ammunition vertically downwardly until the lid passes over each round. When the lid 20 is fully closed, each of the rounds of ammunition will be securely seated and retained within the housing as is shown in FIG. 4.

When it is desired to dispense rounds of ammunition from the container, the lid is urged rearwardly and slides into the channels 53 formed adjacent the rear wall 15 inwardly of the housing. As the lid passes beyond the rounds of ammunition contained in chambers 25*a* and 26*a*, these rounds are automatically raised above the lid by the action of the resilient support or lift pad 35*a*. The vertical lift of the pad 35*a* is limited by the partition 28 which is engaged by the lift plate 40. The rounds are then in a position as shown in FIG. 1 and may be lifted from their frictional engagement within each of the recesses 36 and 37 of support pad 35*a*. The process may be repeated for lifting rounds of ammunition from each of the chambers 25*b–e* and 26*b–e*, respectively.

As previously discussed, different sizes of ammunition may be utilized with the ammunition container of the present invention. The recesses 36 and 37 of the support pads are of a size to insure that small diameter rounds of ammunition are frictionally engaged by the pads and the pads are yieldable to accommodate larger diameter rounds of ammunition. Also, the various lengths of rounds of ammunition are accommodated by the yieldable nature of the support pads 35*a–e*.

The ammunition container housing of the present invention is preferably formed of all plastic materials with the exception of the resilient support pads which may be formed of an open cell soft rubber such as a neoprene rubber material. Other open cell resilient plastic materials may be utilized to form the support pads.

I claim:

1. A portable ammunition container comprising a housing, said housing having an opening formed in the upper end thereof and having opposing side walls and front and rear end walls, a bottom wall joined to said opposing side walls and said front and rear end walls, a plurality of chambers formed within said housing, each of said chambers being spaced with respect to one another by at least one partition means, a resilient foam support pad means provided within each of said chambers, each of said pad means extending from adjacent said bottom wall of said housing upwardly toward and in spaced relationship with respect to the opening therein, a recess formed in each of said pad means for grippingly receiving the bullet end of a round of ammunition therein, each of said pad means being compressible as a round of ammunition is inserted within said recesses therein, and a lid means carried by said housing for selectively closing the opening therein, whereby said pad means are maintained compressed through engagement between said lid means and the other opposite end of the round of ammunition.

2. The portable ammunition container of claim 1 in which said lid means includes a plurality of living hinges which are generally oriented in parallel relationship with respect to one another, said lid means having a forward portion and a rear portion, a pair of opposing guide channels formed in said front and rear side walls of said housing, said lid means being selectively slideably received within said opposing channels said lid means being retained within said housing as said forward portion of said lid means is moved from adjacent said front end wall toward said rear end wall of said housing.

3. The portable ammunition container of claim 1 in which said partition means includes a plurality of first partition elements which are mounted in spaced relationship between said opposing side walls and being generally perpendicular with respect thereto, and at least one second partition element extending generally parallel to said side walls and between each of said first partition elements.

4. The portable ammunition container of claim 3 in which said first partition elements have upper and lower ends, said lower ends being adjacent said bottom wall of said container and said upper ends being in spaced relationship from said opening therein, said second partition element extends from adjacent said upper ends of said first partition elements downwardly to a lower edge in spaced relationship with respect to said bottom wall of said container, said resilient pad means being mounted within said housing so as to be between said first partition elements and lower edge of said second partition element so that each pad means is in communication with at least two adjacent chambers, and at least two recesses in each of said pads means communicating with each of said adjacent chambers.

5. The portable ammunition container of claim 4 including a lift plate means, said recesses in each of said pad means being formed in the upper ends thereof, said lift plate means being mounted to the upper end of each of said pad means, said lift plate means including a pair of openings therein which are in alignment with said recess in said pad means, and said lift plate means being selectively engageable with said lower edge of said second partition element to thereby limit the upward vertical movement of each of said pad means relative to the openings in the container.

6. The ammunition container of claim 5 in which said recesses in said pad means are of a size to frictionally engage the bullet end of a round of ammunition.

7. The portable ammunition container of claim 6 in which said lid means includes a plurality of living hinges which are generally oriented in parallel relationship with respect to one another, said lid means having a forward portion and a rear portion, a pair of opposing guide channels formed in said front and rear side walls of said housing, said lid means being selectively slideably received within said opposing channels said lid means being retained within said housing as said forward portion of said lid means is moved from adjacent said front end wall toward said rear end wall of said housing.

8. The ammunition container of claim 7 in which said forward portion of said lid means includes a projection, said housing including retention means adjacent said front end wall thereof for selectively engaging said projection means when said lid means is closed with respect to said opening in said housing.

9. The ammunition container of claim 8 in which said forward portion of said lid means includes a pair of recesses formed on either side of said projection, said recesses being of a size so as to allow a round of ammunition to be raised therethrough with respect to said opening in said housing when said lid means is opened with respect to said front end wall of said housing.

10. The portable ammunition container of claim 1 in which said recesses in said pad means are of a size to frictionally engage the bullet end of a round of ammunition therein to thereby prevent the accidental displacement of a round of ammunition from each of said chambers when said lid means is open with respect to the opening in said housing.

11. The portable ammunition container of claim 1 including a notch formed in said rear wall, said lid means being slideably movable within said housing, said lid means being engageable through said opening in said rear wall when said lid means is disposed with said housing 12. The portable ammunition container of claim 1 including mounting means extending from one of said side walls of said housing, said mounting means being selectively engageable with an article of clothing so that said housing may be portably carried by an individual.

13. A portable ammunition container comprising a housing, said housing having an opening formed in the upper end thereof and having opposing side walls, front and rear end walls and the bottom wall joined to said opposing side walls and said front and rear end walls, a plurality of first partitioned elements extending between said side walls of said housing and having upper and lower ends, said lower ends of said first partition elements extending adjacent to said bottom wall of said housing and said upper ends thereof extending towards said opening in said housing, a chamber defined between each of said first partition elements, a resilient foam support pad means provided within each of said chambers, each of said pad means extending from adjacent said bottom wall of said housing upwardly toward and in spaced relationship with respect to the opening therein, at least one recess formed in each of said pad means for selectively receiving the bullet end of a round of ammunition therein, said recesses being of a size to frictionally engage the bullet end of a round of ammunition, each of said support pad means being compressible as a round of ammunition is inserted within said recesses therein, and lid means carried by said housing for selectively closing the opening therein, whereby said pad means are maintained compressed through engagement between said lid means and the other opposite end of the round of ammunition.

14. The portable ammunition container of claim 13 including at least one second partition element, said second partition element extending generally parallel with said side walls of said housing and between each of said first partition elements, one of said chambers being formed between each of said first and second partition elements.

15. The portable ammunition container of claim 14 in which said second partition element includes upper and lower edges, said lower edge of said second partition element terminating in spaced relationship with respect to said bottom wall of said housing, each of said pad means being positioned between said lower edge of said second partition element and said bottom wall of said housing and communicating with at least two of said chambers.

16. The portable ammunition container of claim 15 in which said lid means is slidably received within said housing.

* * * * *